US005892165A

United States Patent [19]

Oba et al.

[11] Patent Number: 5,892,165

[45] Date of Patent: Apr. 6, 1999

[54] AUTOMATIC PLAYER PIANO EXACTLY REPRODUCING ACOUSTIC SOUND PRODUCED UNDER MANIPULATION OF SOSTENUTO PEDAL

[75] Inventors: Yasuhiko Oba; Yuji Fujiwara, both of Shizuoka, Japan

[73] Assignee: Yamaha Corporation, Hamamatsu, Japan

[21] Appl. No.: 26,848

[22] Filed: Feb. 20, 1998

[30] Foreign Application Priority Data

Feb. 25, 1997 [JP] Japan ..... 9-041225

[51] Int. Cl.[6] ..... G10C 3/18; G10C 3/26; G10H 1/053

[52] U.S. Cl. ..... 84/20; 84/23; 84/225; 84/236; 84/244; 84/626

[58] Field of Search ..... 84/626–633, 19–23, 84/225–233, 236–255

[56] References Cited

FOREIGN PATENT DOCUMENTS 2-189588 7/1990 Japan .

*Primary Examiner*—Stanley J. Witkowski

*Attorney, Agent, or Firm*—Graham & James LLP

[57] ABSTRACT

An automatic player piano prolongs acoustic sounds in playback as if a player pushes down a sostenuto pedal, and a controller is responsive to a first piece of music data information representative of key-on state, a second piece of music data information representative of key-off state, a third piece of music data information representative of pedal-on state and a fourth piece of music data information representative of pedal-off state so as to play a tune by using key actuators associated with the keys; when the first piece of music data information is supplied to the controller for a key, the controller instructs the key actuators to change associated the key from the key-off state to the key-on state; when the second piece of music data information is supplied to the controller without the third piece of music data information for a key, the controller instructs the key actuator to change the key from the key-on state to the key-off state; when the second piece of music data information is supplied to the controller in the presence of the third piece of music data information for a key, the controller instructs the key actuator to maintain the key in the key-on state; when the fourth piece of music data information is supplied to the controller after receipt of the second piece of music data information, the controller instructs the key actuator to change the key from the key-on state to the key-off state.

4 Claims, 4 Drawing Sheets

| NOTE NUMBER | NOTE FLAG | SOSTENUTO FLAG |
|---|---|---|
| 0 | 0 | 0 |
| ⋮ | ⋮ | ⋮ |
| 60 | 1 | 0 |
| 61 | 0 | 1 |
| ⋮ | ⋮ | ⋮ |
| 127 | 0 | 0 |

AUTOMATIC PLAYER PIANO EXACTLY REPRODUCING ACOUSTIC SOUND PRODUCED UNDER MANIPULATION OF SOSTENUTO PEDAL

FIELD OF THE INVENTION

This invention relates to an automatic player piano and, more particularly, to an automatic player piano exactly reproducing an acoustic sound produced under manipulation of a sostenuto pedal.

DESCRIPTION OF THE RELATED ART

An automatic player piano is a compromise between an acoustic piano and an electric playing system, and either pianist or electric playing system plays a tune on the keyboard. The series of acoustic sounds produced through the fingering of the pianist is hereinbelow referred to as "original performance", and a series of acoustic sounds produced by the electric playing system is referred to as "playback". A key of the keyboard stays in a "rest position" due to the self-weight, and causes an associated hammer to be in a "home position". On the other hand, when force is exerted on the key, the key is moved from the rest position toward an "end position", and an associated key action mechanism rotates the hammer toward a set of strings. In the following description, term "forward" means a direction from the rest position or the home position toward the end position or the set of strings, and term "backward" indicates the direction opposite to the forward direction.

When the pianist depresses a key from the rest position toward the end position, the depressed key spaces the damper head from the set of strings, and the associated key action mechanism drives the hammer for rotation. The hammer strikes the set of strings, and the strings vibrate for producing the acoustic sound. When the pianist releases the depressed key, the key returns toward the rest position, and allows the damper head to be held in contact with the set of strings, again. The damper head takes up the vibrations of the strings, and extinguishes the acoustic sound. Thus, the acoustic piano repeats the key depressing, the striking at the strings, the releasing the key and the absorption of vibrations during the original performance. If the automatic player piano is instructed to record the original performance, a recording system, which is usually further incorporated therein, produces pieces of music data information representative of the original performance, and stores them in a suitable information storage medium.

When the automatic player piano is instructed to reproduce the original performance, the electric playing system reads out the pieces of music data information, and sequentially energizes solenoid-operated key actuators so as to move the keys for the playback.

The acoustic piano is equipped with a pedal system, and two or three pedals are incorporated in the pedal system. One of the pedals is called as a "sostenuto pedal", which enables selected notes to be sustained independently of others. In detail, the sostenuto pedal is linked through a sostenuto pedal with the dampers. Assuming now that the player steps on the sostenuto pedal after depressing some keys, even if the player releases the depressed keys, the associated dampers are hold off, and the acoustic sounds are prolonged. Upon releasing the sostenuto pedal, the dampers are brought into contact with the strings, and extinguish the acoustic sounds. Thus, the sostenuto pedal allows the pianist to arbitrarily determine the timing to extinguish the sounds.

If the acoustic piano of the automatic player piano is equipped with the sostenuto pedal, the electric playing system is expected to reproduce the prolonged acoustic sounds produced under the manipulation of the sostenuto pedal. As described hereinbefore, the electric playing system reproduces the original performance on the basis of the pieces of music data information. The pieces of music data information represent forward key/hammer motions and a backward key motion. A final hammer velocity and an impact time describe the forward key/hammer motions, and a key releasing time and a backward key velocity describe the backward key motion. The key releasing time is defined by time when the released key passes a predetermined point on the trajectory of the key between the rest position and the end position, and the damper is brought into contact with the set of strings at the key releasing time.

The prior art automatic player piano reproduces the acoustic sound prolonged by depressing the sostenuto pedal without manipulation of the sostenuto pedal during the playback. Assuming now that a pianist releases the sostenuto pedal after releasing some keys, the recording system does not give the key releasing time to the released key at passing the predetermined position. When the pianist releases the sostenuto pedal, the recording system determines the pedal releasing time to be the key releasing time for the keys, and produces the pieces of music data information representative of the backward key motions. For this reason, when the electric playing system reproduces the original performance, the solenoid-operated key actuators allow those keys to return toward the rest position at the key releasing time equal to pedal releasing time. Thus, the prior art automatic player piano prolongs the acoustic sounds without manipulation of the sostenuto pedal in the playback.

However, a professional pianist uses the sostenuto pedal in more complicated manner. For example, if a pianist depresses a released key under the manipulation of the sostenuto pedal, the pianist can vary the resonance of the acoustic sound. If the recording system simply determines the pedal releasing time to be the key releasing time, the prior art automatic player piano does not reproduce the variation of resonance, and can not nuance the reproduced performance.

Another problem is poor data compatibility. The pieces of music data information are not available for another kind of automatic player piano, the electric playing system of which has a solenoid-operated pedal actuator for moving the sostenuto pedal. Although the automatic player piano equipped with the solenoid-operated pedal actuator has not been developed as a commercial product, the pieces of music data information for the solenoid-operated key actuators are not available for the automatic player piano equipped with the solenoid-operated pedal actuator.

SUMMARY OF THE INVENTION

It is therefore an important object of the present invention to provide an automatic player piano, which can express the delicate nuance during the playback.

It is also an important object of the present invention to provide an automatic player piano, which is improved in data compatibility.

In accordance with one aspect of the present invention, there is provided an automatic player piano comprising an acoustic piano including a plurality of each changed between key-on state and key-off state, a plurality of sets of strings respectively associated with the plurality of keys for producing acoustic sounds through vibrations thereof, a plurality of hammers respectively driven for rotation by the plurality of keys so as to strike the plurality of sets of strings, a plurality of damper mechanisms respectively linked with the plurality of keys so as to be spaced from the plurality of sets of strings during the key-on state and a sostenuto pedal changed between pedal-on state and pedal-off state by a player and selectively causing the plurality of damper mechanisms to be continuously spaced for prolonging the acoustic sounds and an electric playing system including a plurality of key actuators respectively associated with the plurality of keys so as to selectively change the plurality of keys between the key-on state and the key-off state without fingering of the player, a controlling means responsive to a first piece of music data information representative of the key-on state, a second piece of music data information representative of the key-off state, a third piece of music data information representative of the pedal-on state and a fourth piece of music data information representative of the pedal-off state so as to play a tune by means of the plurality of key actuators, and the controlling means gives instructions as follows: The controlling means supplies a first instruction to one of the plurality of key actuators so as to change associated one of the plurality of keys from the key-off state to the key-on state when the first piece of music data information is supplied thereto for the aforesaid one of the plurality of keys. The controlling means supplies a second instruction to the aforesaid one of the plurality of key actuators so as to change the aforesaid associated one of the plurality of keys from the key-on state to the key-off state when the second piece of music data information is supplied thereto without the third piece of music data information for the aforesaid one of the plurality of keys. The controlling means supplies a third instruction to the aforesaid one of the plurality of key actuators so as to maintain the associated one of the plurality of keys in the key-on state when the second piece of music data information is supplied thereto in the presence of the third piece of music data information for the aforesaid one of the plurality of keys. The controlling means supplies a fourth instruction to the aforesaid one of the plurality of key actuators so as to change the associated one of the plurality of keys from the key-on state to the key-off state when the fourth piece of music data information is supplied thereto after receipt of the second piece of music data information.

BRIEF DESCRIPTION OF THE DRAWINGS

The features and advantages of the automatic player piano will be more clearly understood from the following description taken in conjunction with the accompanying drawings in which.

DESCRIPTION OF THE PREFERRED EMBODIMENT

Structure of Automatic Player Piano

Figure 1A:
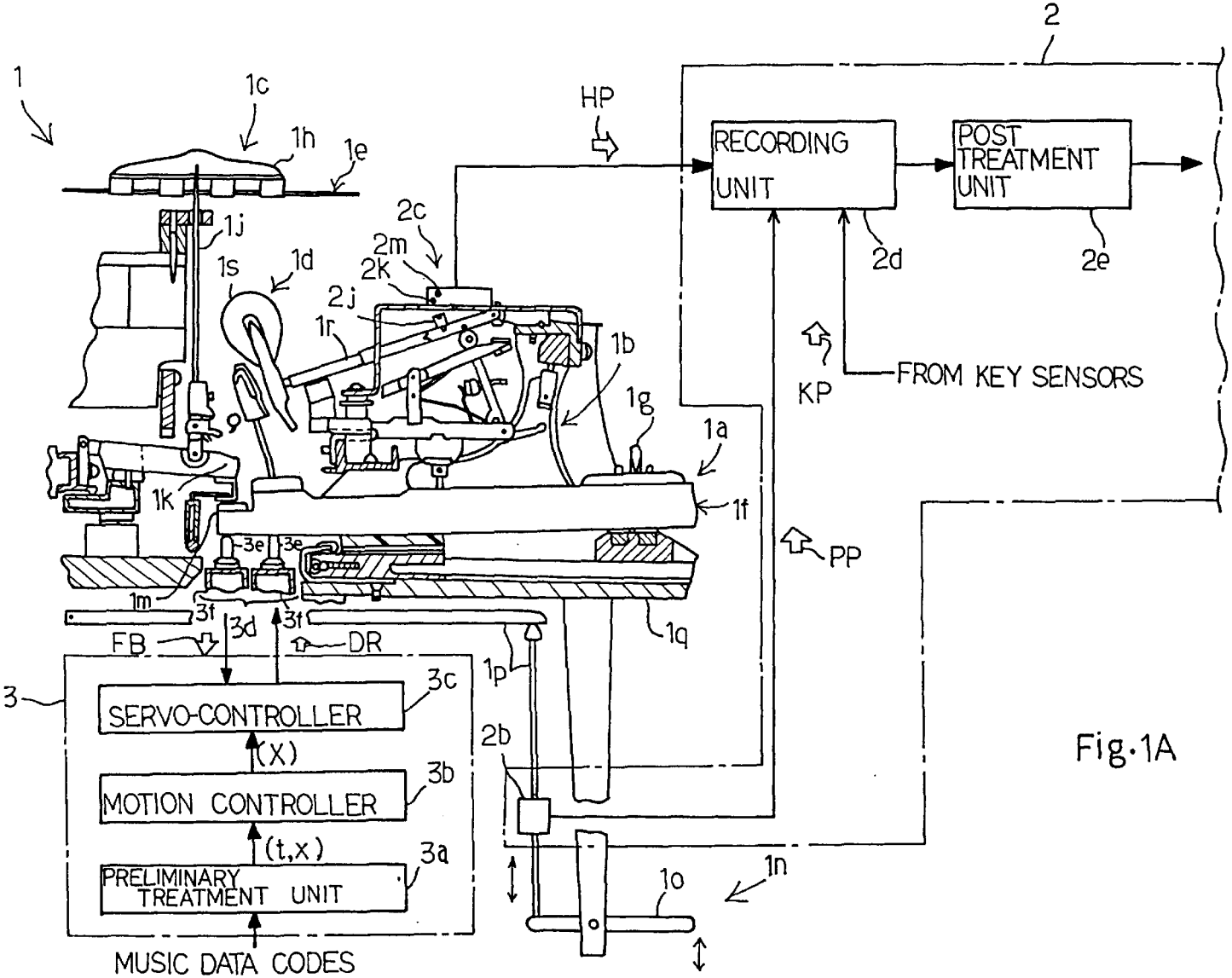
FIGS. 1A and 1B are partially cut-away side views showing the structure of an automatic player piano according to the present invention.
Figure 1B:
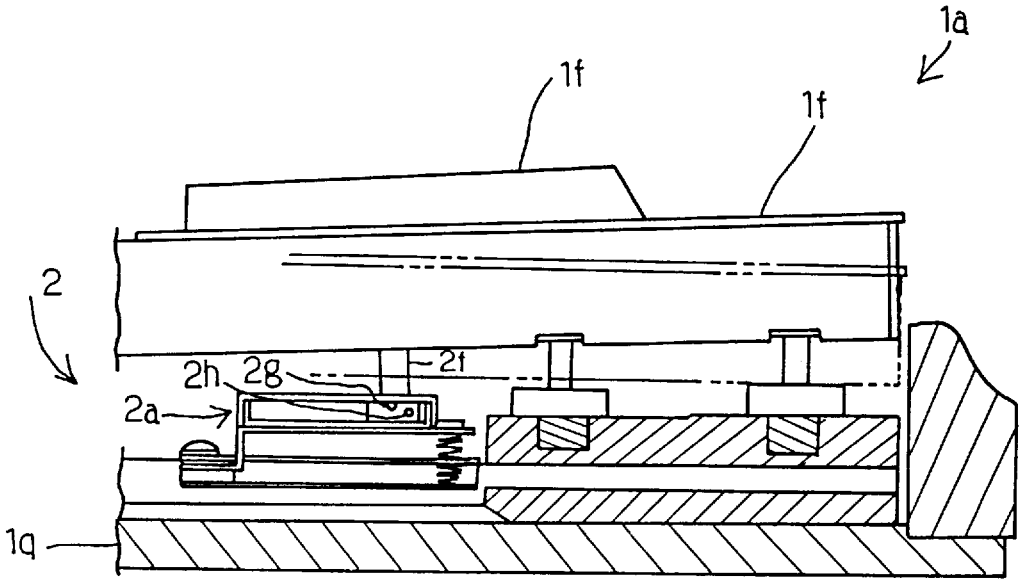

Referring to FIGS. 1A and 1B, an automatic player piano embodying the present invention largely comprises an acoustic piano 1, a recording system 2 and an electric playing system 3. In the following description, word "front" means a position closer to a pianist than a "rear" position.

The acoustic piano comprises a keyboard 1*a*, a plurality of key action mechanisms 1*b*, a plurality of damper mechanisms 1*c*, a plurality of hammer assemblies 1*d* and a plurality of sets of strings 1*e*. A plurality of keys 1*f* form the keyboard 1*a*, and notes of a scale are respectively assigned to the plurality of keys 1*f*. Each of the keys 1*f* is turnable between the rest position and the end position with respect to a balance key pin 1*g*, and stays at the rest position without force exerted on the front portion thereof.

The key action mechanisms 1*b* are provided between the plurality of keys 1*f* and the associated hammer assemblies 1*d*, respectively, and the key action mechanisms 1*b* are actuated by the keys 1*f* so as to drive the associated hammer assemblies 1*d* for rotation. The function of the key action mechanism 1*b* is well known to a person skilled in the art, and no further description is incorporated hereinbelow.

The damper mechanism 1*c* includes a damper head 1*h* connected through a damper wire 1*j* to a damper lever 1*k*, and the rear end portion 1*m* of the key 1*f* lifts the damper lever 1*k* during the forward key motion. On the other hand, while the key 1*f* is returning toward the rest position, the rear end portion 1*m* allows the damper head 1*h* to go down due to the self-weight thereof, and the damper head 1*h* is brought into contact with the set of strings 1*e*, again.

The acoustic piano further comprises a pedal system 1*n* for imparting effects to acoustic sounds. A sostenuto pedal 1*o* and a link mechanism 1*p* are incorporated in the pedal system 1*n*, and the link mechanism 1*p* is connected between the sostenuto pedal 1*o* and the damper mechanisms 1*c*. The sostenuto pedal 1*o* is pressed down by a pianist during an original performance, and the link mechanism 1*p* holds the damper heads 1*c* already spaced from the strings 1*e* off. Thus, the sostenuto pedal 1*o* prolongs the vibrations of the strings 1*e* by holding the damper heads 1*h* off. When the pianist releases the sostenuto pedal 1*o*, the link mechanism 1*p* allows the damper mechanisms 1*c* to bring the damper heads 1*h* into contact with the strings 1*e*, again, and the damper heads 1*h* take up the vibrations of the strings 1*e*.

The recording system 2 includes a plurality of key sensors 2*a* respectively associated with the keys 1*f*, a pedal sensor 2*b* associated with the sostenuto pedal 1*o*, a plurality of hammer sensors 2*c* respectively associated with the hammer assemblies 1*d*, a recording unit 2*d* connected to the sensors 2*a*/2*b*/2*c* for producing pieces of music data information representative of an original performance and a post treatment unit 2*e* connected to the recording unit 2*d*.

The key sensor 2*a* is implemented by a combination of shutter plate 2*f* and photo-interrupters 2*g*/2*h*, and supplies a two-bit key position signal KP to the recording unit 2*d*. The shutter plate 2*f* is attached to the lower surface of the associated key 1*f*, and is movable with respect to the key bed 1*q*. The photo-interrupters 2*g*/2*h* are spaced along the trajectory of the shutter plate 2*f*, and are stationary with respect to a key bed 1*q* where the keyboard 1*a* is mounted. The photo-interrupters 2*k*/2*m* radiate optical beams across the trajectory of the shutter plate 2*f*. The shutter plate 2*f* successively interrupts the optical beams during the forward key motion, and allows the optical beams to pass the trajectory during the backward key motion. Thus, the key sensor 2*a* changes the two-bit key position signal KP depending upon the current key position on the trajectory.

The hammer sensor 2*c* includes a shutter plate 2*j* attached to the hammer shank 1*r* of the associated hammer assembly 1*d* and photo-interrupters 2*k*/2*m* stationary with respect to the key bed 1*q*, and the photo-interrupters 2*k* and 2*m* are spaced along the trajectory of the shutter plate 2*j*. The hammer sensor 2*c* supplies a two-bit hammer position signal HP to the recording unit 2*d*. When the hammer assembly 1*d* is driven for rotation, the shutter plate 2*j* sequentially interrupts the optical beams of the photo-interrupters 2*k*/2*m* during the forward hammer motion. On the other hand, after rebounding on the strings 1*e*, the shutter plate 2*j* allows the photo-interrupters 2*k*/2*m* to successively bridge the optical beams between the photo-emitting elements and the photo-detecting elements. Thus, the hammer sensor 2*c* changes the two-bit hammer position signal HP depending upon the current hammer position.

The pedal sensor 2*b* is inserted between suitable link members of the link mechanism 1*p*, and supplies a pedal status signal PP to the recording unit 2*d*. In this instance, the pedal sensor 2*b* simply indicates depressed state (pedal-on state) or released state (pedal-off state), and is implemented by an electric switch provided at an intermediate position on the pedal trajectory. The pedal sensor may produce a multi-bit pedal position signal representative of a current pedal position.

The recording unit 2*d* periodically checks the key position signals KP, the hammer position signals HP and the pedal position signal PP to see whether or not a pianist moves the keys 1*f* and the sostenuto pedal 1*o*. When the pianist moves a key 1*f*, the key 1*f* is downwardly moved along the key trajectory, and the key action mechanism 1*b* drives the hammer assembly 1*d* for rotation. For this reason, the shutter plate 2*f* attached to the key 1*f* changes the bit pattern of the key position signal KP depending upon the current key position along the key trajectory, and the shutter plate 2*j* attached to the hammer assembly 1*d* changes the bit pattern of the hammer position signal HP depending upon the current hammer position on the forward hammer trajectory.

The recording unit 2*d* calculates the forward key velocity on the basis of the lapse of time between the interruption of the photo-interrupter 2*g* and the interruption of the photo-interrupter 2*h*, and determines a key depressing time at the interruption of the photon-interrupter 2*h*. The key depressing time is representative of occurrence of a key-on event. The recording unit 2*d* further calculates the forward hammer velocity on the basis of the lapse of time between the interruption of the photo-interrupter 2*m* and the interruption of the photo-interrupter 2*k*, and determines an impact time to be the interruption at the photo-interrupter 2*m*. The impact time is representative of occurrence of a hammer event.

On the other hand, when the pianist releases the depressed key 1*f*, the key 1*f* returns toward the rest position, and the key sensor 2*a* changes the bit pattern of the key position signal KP depending upon the current key position on the backward key trajectory. The recording unit 2*d* calculates a released key velocity on the basis of the lapse of time between the photo-interrupters 2*h* and 2*g*, and determines a key releasing time to be the interruption of the photo-interrupter 2*g*. The key releasing time is representative of occurrence of a key-off event.

If the pianist depresses the sostenuto pedal 1*o* during the original performance, the pedal sensor 2*b* changes the pedal status signal PP from the released state to the depressed state, and supplies the pedal status signal PP representative of the depressed state to the recording unit 2*d*. In this way, the key sensors 2*a*, the hammer sensors 2*c* and the pedal sensor 2*b* inform the recording unit 2*d* of the current key positions, the current hammer positions and the current pedal status during the original performance, and the recording unit 2*d* produces pieces of music data information representative of hammer motions, key motions and pedal status. The recording unit 2*d* supplies the pieces of music data information to the post treatment unit 2*e*.

The post treatment unit 2*e* normalizes the hammer motions, the key motions and the pedal status, and formats the normalized music data information into a music data code. In detail, a commercial product of the automatic player piano has individualities due to differences in sensor position, margins of the component parts and dimensions after the assemblage, and the individualities affect the key motions, the hammer motions and the pedal status. If a product of the automatic player piano is requested to reproduce an original performance on the basis of the pieces of music data information produced by another product, the reproduced performance is possibly different from the original performance due to the individualities. In order to eliminate influences of the individualities from the pieces of music data information, the post treatment unit 2*e* converts the pieces of music data information to pieces of music data information produced by an ideal automatic player piano, and the data conversion is called as "normalization".

After the normalization, the post treatment unit 2*e* formats impact data GD such as the final hammer velocity and the impact time, released key data RD such as the released key velocity and the key releasing time, sostenuto data SD representative of the current pedal status and interval data TD representative of lapse of time between the events into music data codes ED. An identifier is added to the music data code ED so as to indicate the kind of data GD/RD/SD/TD. Thus, the recording system 2 produces the sostenuto data SD independently of the released key data RD. If an automatic player piano is equipped with a solenoid-operated pedal actuator, the electric playing system 3 controls the solenoid-operated pedal actuator in response to the sostenuto data SD so as to move the sostenuto pedal at appropriate timings.

The music data codes ED are supplied from the post treatment unit 2*e* to another electronic musical instrument or a suitable information storage medium such as, for example, a hard disk or a floppy disk.

The electric playing system 3 includes a preliminary treatment unit 3*a*, a motion controller 3*b*, a servo-controller 3*c* and solenoid-operated key actuators 3*d*. The solenoid-operated key actuators 3*d* are provided under the rear positions 1*m* of the keys 1*f*, respectively, and have respective plungers 3*e* projectable from respective solenoids 3*f*. Driving signals DR energize the solenoids 3*f*, and the electromagnetic force is exerted on the associated plungers 3*e*. As a result, the plungers 3*e* project from the solenoids 3*f*, and push the rear end portions 1*m* of the associated keys 1*f*. Though not shown in the drawings, built-in plunger sensors are respectively incorporated in the solenoid-operated key actuators 3*d*, and supply plunger position signals representative of current plunger positions to the servo-controller 3*c*.

The music data codes ED are supplied to the preliminary treatment unit 3*a*, and the preliminary treatment unit 3*a* determines a forward key trajectory for each key 1*f* to be depressed and a backward key trajectory for each key 1*f* to be released on the basis of the music data codes ED. The forward/backward key trajectories are represented by a series of positional data or a target position varied with time (t, X). If the music data codes ED are stored in an information storage medium, the preliminary treatment unit 3*a* in the order of events identified by the interval data TD. In this instance, any pedal actuator is not provided for the sostenuto pedal 1*o*, and the preliminary treatment unit 3*a* is responsive to the sostenuto data SD so as to modify the backward key trajectories for the keys released during the manipulation of the sostenuto pedal 1*o*. The key if on the modified backward trajectory prevents the vibrating strings 1*e* from the absorption with the damper head 1*h* during the pedal-on state.

The preliminary treatment unit 3*a* supplies the series of positional data (t, X) to the motion controller 3*b*, and the motion controller 3*b* produces a series of target plunger positions (X) from the series of positional data (t, X). The motion controller 3*b* supplies the series of target plunger positions (X) to the servo-controller 3*c*, and the servo-controller 3*c* regulates the magnitude of the driving signal DR in such a manner as to match the current plunger position with the target plunger position.

Preliminary Treatment Unit

Figures 2, 3:
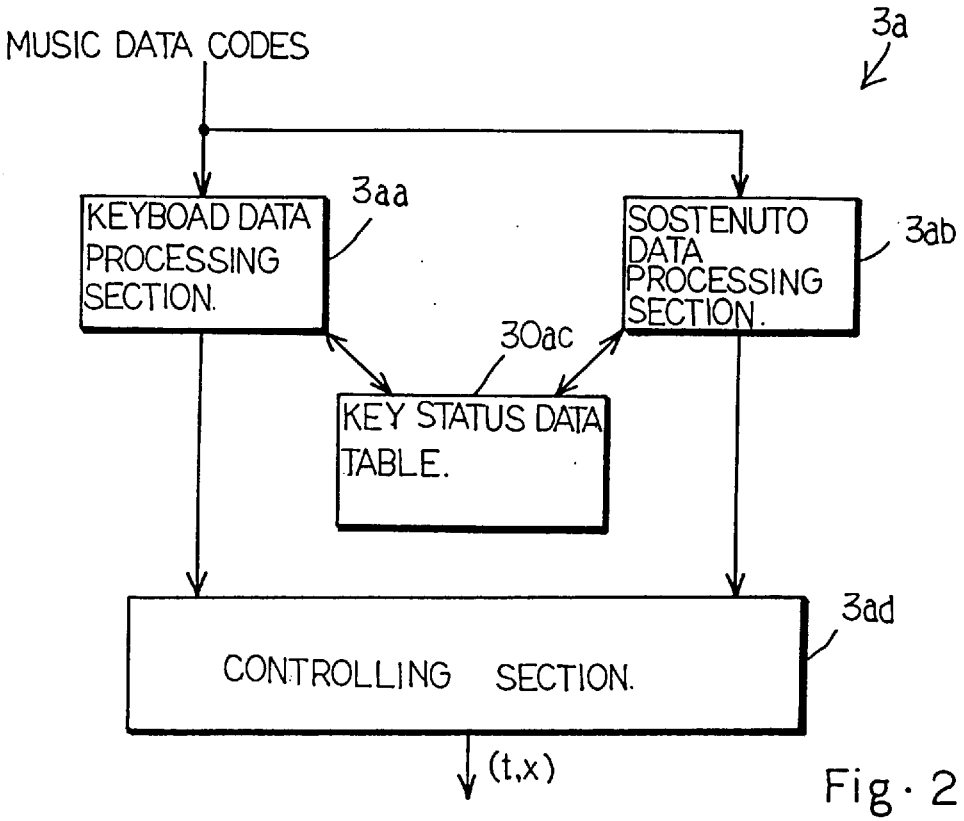
FIG. 2 is a block diagram showing functions of a preliminary treatment unit incorporated in the automatic player piano.
FIG. 3 is a view showing a note flag associated with a sostenuto flag.

FIG. 2 illustrates function blocks of the preliminary treatment unit 3*a*. The preliminary treatment unit 3*a* is functionally broken down into a keyboard data processing section 3*aa*, a sostenuto data processing section 3*ab*, a key status data table 3*ac* and a controlling section 3*ad*. The key status data table 3*ac* is illustrated in FIG. 3. Key numbers are respectively assigned to the keys 1*f* forming the keyboard 1*a*, and a note flag and a sostenuto flag are given to each of the key numbers. The sostenuto flag of "0" and the sostenuto flag of "1" are indicative of the pedal-off state and the pedal-on state, respectively, and the note flag of "0" and the note flag of "1" are representative of the key-off state and the key-on state, respectively. In the following description, a key 1*f* is identified by the key number. For example the key 1*f* with note number "60" is represented as key "60". The note flag is rewritten by the keyboard data processing section 3*aa*, and the sostenuto data processing section 3*ab* changes the sostenuto flag between "0" and "1". For example, the note flag "1" of the key "60" represents that the key "60" causes the associated hammer assembly 1*d* to strike the strings 1*e*. On the other hand, the sostenuto flag "1" of the key "61" represents that the sostenuto pedal 1*o* prevents the vibrating strings 1*e* from the damper head 1*h* after the release of the key "61". The note flag and the sostenuto flag form in combination key status data JD for each key 1*f*.

Turning back to FIG. 2, the music data codes are supplied from the information storage medium to the keyboard data processing section 3*aa* and the sostenuto data processing section 3*ab*. The keyboard data processing section 3*aa* extracts the impact data GD and the released key data RD from the music data codes ED. The keyboard data processing section 3*aa* checks the key status data table 3*ac* to see what is current key status of a given key 1*f*, and rewrites the note flag. When the impact data GD is supplied to the keyboard data processing section 3*aa*, the keyboard data processing section 3*aa* changes the note flag from "0" to "1" at the impact time. On the other hand, when the released key data RD is supplied to the keyboard data processing section 3*aa*, the keyboard data processing section 3*aa* rewrites the note flag to "0" at the key releasing time. Thus, the keyboard data processing section 3*aa* reflects the impact/released data GD/RD on the key status data table.

The keyboard data processing section 3*aa* is further operative to produce an instruction for key releasing and an instruction for key depressing in response to the impact data GD and the released key data RD, and the instructions are supplied to the controlling section 3*ad*. Even though the released key data RD is received, the keyboard data processing section 3*aa* does not supply the instruction for key releasing in so far as the sostenuto flag is indicative of the pedal-on.

The sostenuto data processing section 3*ab* extracts the sostenuto data SD from the music data codes ED, and changes the sostenuto flag. In detail, when the sostenuto data SD is representative of the pedal-on, the sostenuto data processing section 3*ab* checks the key status data table 3*ac* to see what keys 1*f* have the note flag "1", and gives the sostenuto flag "1" to the depressed keys 1*f* identified by the note flag of "1". For example, when the sostenuto data processing section 3*ab* receives the sostenuto data SD representative of the pedal-on state, the sostenuto data processing section 3*ab* changes the sostenuto flag of the key "60" to "1" (see FIG. 3). On the other hand, when the sostenuto data processing section 3*ab* receives the sostenuto data SD representative of the pedal-off state, the sostenuto data processing section 3*ab* checks the key status data table 3*ac* to see what keys have both of the note flag "0" and the sostenuto flag "1". The sostenuto data processing section 3*ab* changes the sostenuto flag of the selected keys 1*f* from "1" to "0", and supplies the instruction for releasing the selected keys 1*f* to the controlling section 3*ad*.

Thus, the keyboard data processing section 3*aa* and the sostenuto data processing section 3*ab* cooperate with each other for controlling the key motions. Assuming now that the key "60" has the note flag "1" and the sostenuto flag "0" as shown in FIG. 3, the associated hammer assembly 1*d* is going to strike or has struck the strings 1*e*. When the sostenuto data processing section 3*ab* receives the sostenuto data SD representative of the pedal-on status, the sostenuto data processing section 3*ab* changes the sostenuto flag to "1". Thereafter, the released key data RD for the key "60" arrives at the keyboard data processing section 3*aa*. The keyboard data processing section 3*aa* checks the key status data table to see whether the sostenuto flag is "1" or "0", and acknowledges that the key "60" has the sostenuto flag of "1". Then, the keyboard data processing section 3*aa* changes the note flag from "1" to "0" without generation of the instruction for releasing the key. For this reason, the key "60" remains depressed. Then, the key "60" has both of the note flag of "0" and the sostenuto flag of "1". Subsequently, the sostenuto data SD for the pedal-off arrives at the sostenuto data processing section 3*ab*, and the sostenuto data processing section 3*ab* checks the key status data table 3*ac* to see what status the key "60" has. The sostenuto data processing section 3*ab* acknowledges that the key "60" has the note flag "0" and the sostenuto flag "1". The sostenuto data processing section 3*ab* supplies the instruction for releasing key to the controlling section 3*ad*, and changes the sostenuto flag 3*ab* to "0". The controlling section 3*ab* produces a series of positional data (t, X) representative of the backward key trajectory, and the key "60" is moved along the backward key trajectory. Then, the damper head 1*h* is brought into contact with the set of strings 1*e*, and takes up the vibrations of the strings 1*e*.

The controlling section 3*ad* is responsive to the instructions supplied from the keyboard data processing section 3*aa* and the instruction supplied from the sostenuto data processing section 3*ab* so as to produce the series of positional data (t, X) for each of the keys 1*f* to be depressed or released.

Program Sequence

Figure 4:
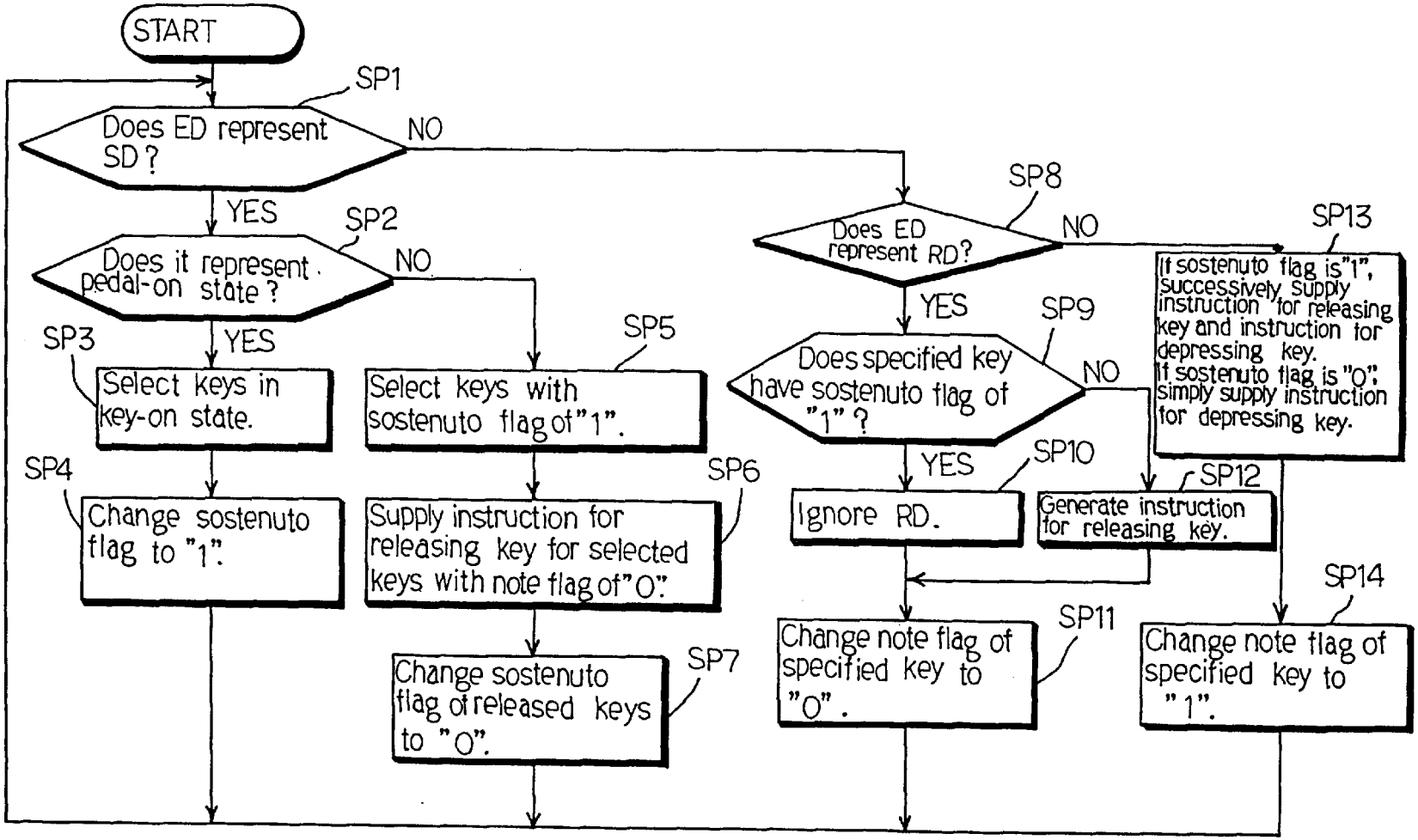
FIG. 4 is a flow chart showing the behavior of the preliminary treatment unit.

FIG. 4 illustrates a program sequence executed by the preliminary treatment unit 3*a*. When a music data code ED arrives at the preliminary treatment unit 3*a*, the preliminary treatment unit 3*a* checks the identifier attached to the music data code ED to see whether or not the music data code ED represents the sostenuto data SD as by step SP1. If the answer at step SP1 is given affirmative, the preliminary treatment unit 3*a* checks the sostenuto data SD to see whether or not it represents the pedal-on state as by step SP2.

If the answer at step SP2 is given affirmative, the preliminary treatment unit 3*a* proceeds to step SP3, and selects the keys in the key-on state from the key status data table 3*ac*. Subsequently, the preliminary treatment unit 3*a* changes the sostenuto flag of the selected keys 1*f* to "1" as by step SP4, and returns to step SP1. The solenoid-operated key actuators 3*d* maintain the plungers 3*e* in projected state, and the selected keys 1*f* remain depressed. For this reason, the acoustic sounds are prolonged.

On the other hand, if the sostenuto data SD represents the pedal-off, the answer at step SP2 is given negative, and the preliminary treatment unit 3*a* proceeds to step SP5. The preliminary treatment unit 3*a* selects the keys 1*f* with the sostenuto flag of "1" at step SP5, and supplies the instruction for releasing key to the controlling section 3*ad* so as to release the selected keys with the note flag of "0" as by step SP6. The controlling section 3*ad* produces a series of positional data (t, X) representative of a backward key trajectory for each of the keys 1*f* to be released, and supplies the positional data (t, X) to the motion controller 3*b*.

After step SP6, the preliminary treatment unit 3*a* changes the sostenuto flag of each of the released keys 1*f* to "0" representative of the pedal-off state as by step SP7. In this way, when the music data code ED representative of the sostenuto data SD is supplied to the preliminary treatment unit 3*a*, the preliminary treatment unit 3*a* repeats the loop consisting of steps SP1 to SP7, and the loop SP1 to SP7 is realized by the sostenuto data processing section 3*ab* in FIG. 2.

On the other hand, if the music data code ED is representative of another kind of data, the answer at step SP1 is given negative, and the preliminary treatment unit 3*a* checks the music data code ED to see whether or not it represents the released key data RD as by step SP8.

If the answer at step SP8 is given affirmative, the preliminary treatment unit 3*a* selects one of the keys 1*f* specified by the released key data RD, and checks the key status data table 3*ac* to see whether or not the sostenuto flag of the specified key 1*f* represents the pedal-on state as by step SP9. If the answer at step SP9 is given affirmative, it is necessary to prolong the acoustic sound, and the preliminary treatment unit 3*a* ignores the released key data RD as by step SP10. In other words, the preliminary treatment unit 3*a* does not generate the instruction for releasing the key. After step SP10, the preliminary treatment unit 3*a* changes the note flag of the specified key 1*f* to "0" representative of the key-off state as by step SP11, and returns to step SP1.

On the other hand, if the sostenuto flag of the specified key 1*f* is "0" or in the pedal-off state, the answer at step SP9 is given negative, and the preliminary treatment unit 3*a* generates the instruction for releasing the key as by step SP12. The controlling unit 3*ad* is responsive to the instruction for releasing the key for producing a series of positional data (t, X) representative of a backward key trajectory. After step SP12, the preliminary treatment unit 3*a* proceeds to step SP11.

If the music data code ED does not represent the released key data RD, the answer at step SP8 is given negative, and the preliminary treatment unit 3*a* acknowledges the music data code ED to represent the impact data GD. Then, the preliminary treatment unit 3*a* proceeds to step SP13. The preliminary treatment unit 3*a* selects one of the keys specified by the impact data GD, and achieves the following jobs at step SP13.

First, the preliminary treatment unit 3*a* checks the key status data table 3*ac* to see whether the sostenuto flag of the specified key 1*f* represents the pedal-on state or the pedal-off state. If the sostenuto flag represents the pedal-on state, the specified key 1*f* remains in the end position, and it is impossible to depress it. For this reason, the preliminary treatment unit 3*a* supplies the instruction for releasing the key to the controlling section 3*ad*, and makes the specified key 1*f* ready for depressing. Thereafter, the preliminary treatment unit 3*a* supplies the instruction for depressing the key to the controlling section 3*ad*. Thus, the preliminary treatment unit 3*a* can reproduce the complicated key motion, i.e., releasing the key under the pedal-on state and immediately depressing it without releasing the sostenuto pedal. If the sostenuto data SD simply retards the release of the key as carried out by the prior art automatic player piano, the forward key motion under the pedal-on state is missing, because the key is still in the end position.

On the other hand, if the sostenuto flag represents the pedal-off state, the preliminary treatment unit 3*a* simply supplies the instruction for releasing the key to the controlling section 3*ad*.

After step SP13, the preliminary treatment unit 3*a* changes the note flag of the specified key to "1" as by step SP14, and returns to step SP1. Thus, the preliminary treatment unit 3*a* processes the released key data RD and the impact data GD through the loop consisting of steps SP1 and SP8 to SP14, and the execution through the loop is corresponding to the keyboard data processing section 3*aa* in FIG. 2.

As will be appreciated from the foregoing description, the automatic player piano according to the present invention records the pedal state of the sostenuto pedal 1*o* independently of the key motion, and both sostenuto and impact/releasing key data SD/GD/RD independently form parts of the music data codes ED. For this reason, the music data codes are available for both of an automatic player piano equipped with a pedal actuator and the automatic player piano without the pedal actuator. Thus, the automatic player piano according to the present invention enhances the data compatibility.

The electric player system 3 according to the present invention ignores the key releasing data RD in the presence of the sostenuto flag representative of the pedal-on state in the playback (see step SP10), and the associated solenoid-operated key actuators 3*d* maintains the key at the end position. If the electric player system 3 is supplied with the sostenuto data SD representative of the pedal-off state before the impact data GD, the electric player system 3 causes the key 1*f* to return toward the rest position (see step SP6). On the other hand, if the electric player system 3 is supplied with the impact data GD before receipt of the sostenuto data SD representative of the pedal-off state, the electric player system 3 supplements the instruction for releasing the key, and, thereafter, causes the key to be depressed (see step SP13). Thus, the automatic player piano faithfully reproduces the complicated key motion in the playback.

Although a particular embodiment of the present invention has been shown and described, it will be obvious to those skilled in the art that various changes and modifications may be made without departing from the spirit and scope of the present invention.

For example, the acoustic piano may be an upright piano, and the present invention may appertain to another kind of keyboard musical instrument such as, for example, an organ.

The key may be released until a deep position on the backward key trajectory such as, for example, 6 millimeters under the rest position so as to allow the electric player system 3 to depress the key before the damper head 1*h* is brought into contact with the strings 1*e*.

When the sostenuto data SD represents the pedal-on state, the electric player system 3 may maintain a key 1*f* at an intermediate position on the forward key trajectory such as 9 millimeters under the rest position so that a pianist conforms the pedal-on state through the position of the key 1*f*.

The pedal sensor 2*b* may measure the velocity of the sostenuto pedal 1*o* so as to record the pedal velocity. In this instance, the electric player system 3 may calculate a target backward key velocity on the basis of the pedal velocity in the playback so as to control the released key.

What is claimed is:

1. An automatic player piano comprising an acoustic piano including a plurality of keys each changed between key-on state and key-off state, a plurality of sets of strings respectively associated with said plurality of keys for producing acoustic sounds through vibrations thereof, a plurality of hammers respectively driven for rotation by said plurality of keys so as to strike said plurality of sets of strings, a plurality of damper mechanisms respectively linked with said plurality of keys so as to be spaced from said plurality of sets of strings during said key-on state and a sostenuto pedal changed between pedal-on state and pedal-off state by a player and selectively causing said plurality of damper mechanisms to be continuously spaced for prolonging said acoustic sounds, and an electric playing system including a plurality of key actuators respectively associated with said plurality of keys so as to selectively change said plurality of keys between said key-on state and said key-off state without fingering of said player, a controlling means responsive to a first piece of music data information representative of said key-on state, a second piece of music data information representative of said key-off state, a third piece of music data information representative of said pedal-on state and a fourth piece of music data information representative of said pedal-off state so as to play a tune by means of said plurality of key actuators, said controlling means supplying a first instruction to one of said plurality of key actuators so as to change associated one of said plurality of keys from said key-off state to said key-on state when said first piece of music data information is supplied thereto for said one of said plurality of keys, said controlling means supplying a second instruction to said one of said plurality of key actuators so as to change said associated one of said plurality of keys from said key-on state to said key-off state when said second piece of music data information is supplied thereto without said third piece of music data information for said one of said plurality of keys, said controlling means supplying a third instruction to said one of said plurality of key actuators so as to maintain said associated one of said plurality of keys in said key-on state when said second piece of music data information is supplied thereto in the presence of said third piece of music data information for said one of said plurality of keys, said controlling means supplying a fourth instruction to said one of said plurality of key actuators so as to change said associated one of said plurality of keys from said key-on state to said key-off state when said fourth piece of music data information is supplied thereto after receipt of said second piece of music data information.

2. The automatic player piano as set forth in claim 1, in which said controlling means includes a status table having a plurality of memory locations respectively assigned to said plurality of keys, each of said plurality of keys storing a key number assigned to said one of said plurality of keys, a note flag representative of key status changed between said key-on state and said key-off state by using said first piece of music data information and said second music data information and a sostenuto flag representative of pedal status changed between said pedal-on state and said pedal-off state by using said third piece of music data information and said fourth piece of music data information, a key data processing sub-means supplied with said first piece of music data information and said second piece of music data information and checking said status table before selectively producing said first instruction, said second instruction and said third instruction, a sostenuto data processing sub-means supplied with said third piece of music data information and said fourth piece of music data information and checking said status table before producing said fourth instruction, and a controlling sub-means responsive to said first instruction for providing a forward trajectory to said one of said plurality of actuators and to said second instruction and said fourth instruction for providing a backward trajectory to said one of said plurality of actuators.

3. The automatic player piano as set forth in claim 1, in which said controlling means supplies said first instruction to said one of said plurality of actuators if said fourth piece of music data information has been already supplied to said one of said plurality of keys, and said controlling means supplies a fifth instruction to said one of said plurality of actuators before said first instruction so as to change said one of said plurality of keys from said key-on state to said key-off state if said third piece of music data information has been already supplied to said one of said plurality of keys.

4. The automatic player piano as set forth in claim 3, in which said controlling means includes a status table having a plurality of memory locations respectively assigned to said plurality of keys, each of said plurality of keys storing a key number assigned to said one of said plurality of keys, a note flag representative of key status changed between said key-on state and said key-off state by using said first piece of music data information and said second piece of music data information and a sostenuto flag representative of pedal status changed between said pedal-on state and said pedal-off state by using said third piece of music data information and said fourth piece of music data information, a key data processing sub-means supplied with said first piece of music data information and said second piece of music data information and checking said status table before selectively producing said first instruction, said second instruction, said third instruction and said fifth instruction, a sostenuto data processing sub-means supplied with said third piece of music data information and said fourth piece of music data information and checking said status table before producing said fourth instruction, and a controlling sub-means responsive to said first instruction for providing a forward trajectory to said one of said plurality of actuators and to said second instruction and said fourth instruction for providing a backward trajectory to said one of said plurality of actuators.

* * * * *